United States Patent [19]

Battles

[11] Patent Number: 4,793,724

[45] Date of Patent: Dec. 27, 1988

[54] PRINTING SUPPORT AND METHOD FOR PLACING LABELS ON A TRANSPARENT RECORD MEDIUM

[76] Inventor: George C. Battles, 7611 South Allison Circle, Unit C, Littleton, Colo. 80235

[21] Appl. No.: 897,256

[22] Filed: Aug. 18, 1986

[51] Int. Cl.[4] ..... B41J 1/24

[52] U.S. Cl. ..... 400/174; 400/158; 400/188; 400/466; 40/595

[58] Field of Search ..... 400/134, 153, 154, 154.1, 400/158, 159, 174, 462, 466, 611, 613, 615.2, 144.2, 149, 188, 466; 40/594, 595, 600, 588; 156/239, 240; 427/146, 147, 148, 149; 283/67

[56] References Cited

U.S. PATENT DOCUMENTS

| | | | |
|---|---|---|---|
| 2,200,932 | 5/1940 | Neidich | 400/466 |
| 3,280,954 | 10/1966 | Bremer et al. | 400/613 |
| 3,315,601 | 4/1967 | Borack | 400/134.5 |
| 3,834,507 | 9/1974 | Bradshaw | 400/613 |
| 3,849,913 | 11/1974 | Williams, Sr. | 40/594 |
| 4,462,708 | 7/1984 | Laurtes et al. | 400/154.5 |

FOREIGN PATENT DOCUMENTS

| | | | |
|---|---|---|---|
| 116382 | 8/1984 | European Pat. Off. | 400/466 |
| 165246 | 8/1985 | Japan | 400/188 |

*Primary Examiner*—David A. Wiecking

*Attorney, Agent, or Firm*—Fields, Lewis, Pittenger & Rost

[57] ABSTRACT

An improved printing support and method for use in a conventional dry lettering printing machine of the type having a print station, a rotatable printing support having print characters thereon, and means for causing the machine to execute a print cycle which includes providing a color carrying ribbon and image carrying tape at the print station, aligning the ribbon, tape, and a selected print character at the print station for printing, exerting a printing force at the print station, and reciprocating the tape cartridge to advance the tape and ribbon to print the next character at the print station. The improvement comprises inverting the print characters relative to a readable orientation so that when the characters are printed on a first tape surface and the tape is inverted, the characters appear in the correct sequence and orientation when viewed through the tape from a second tape surface opposite the first. The tape will thus be readable when inverted and placed on the underside of a transparent sheet.

6 Claims, 2 Drawing Sheets

PRINTING SUPPORT AND METHOD FOR PLACING LABELS ON A TRANSPARENT RECORD MEDIUM

TECHNICAL FIELD

The present invention relates to a printing support and method for printing characters on a tape. More particularly, the present invention relates to an improved printing support having inverted characters thereon for printing on an image-carrying tape which tape is then inverted and secured to the bottom surface of a transparent drawing sheet.

BACKGROUND ART

Numerous tape lettering or printing apparatus and processes are known in the prior art. Typical examples of such apparatus and processes are shown and described in U.S. Pat. Nos. 3,280,954; 3,315,601; 3,834,507; and 4,462,708. These apparatuses and processes are widely used, and are applied extensively in the field of architectural and engineering drafting where the tapes are used to letter and number the drawings produced. In this application, the tape normally has an adhesive backing which is peeled off after printing, allowing the tape to be adhesively secured to a transparent drawing sheet. Drawings are often revised, added to, and printed from the transparent drawing sheet numerous times before final completion. This process of constant handling of the drawing sheets creates problems with printed tape attached in the conventional manner to the upper surface of the sheets. The lettering on the tape may become smudged from being rubbed by hands, elbows, and so on. Similarly, the tape often becomes scratched by contact with rough or sharp edges, as on a T-square or other drawing tools. Edges of the tape may also become caught on an object passing over the tape, resulting in loosening of the tape and curling back of its edges.

Several solutions have been tried to alleviate the problems mentioned above, with varying degrees of success. Laminators have been used to apply a clear tape over the printed tape to protect it. This solution protects against smudging, but nonetheless leaves the laminated tape on top of the drawing where it remains vulnerable to scratching, peeling and becoming dirty. In addition, lamination requires an extra step in the lettering process, as well as the added expense of the laminating material and the laminating cartridge and mechanism. An alternative sometimes used has been to spray a coating or "fixative" onto the tape to protect the lettering. This process also leaves the tape on the top surface of the drawing sheet, where it is subject to the same disadvantages already discussed. Further, the spraying process is a delicate one in which too much spraying can result in the ink of the letters "running", while too little spraying will afford insufficient protection. Spraying must be performed away from the drawing, and may not be done when the tape is on the drawing. Spray-coating thus requires a time-consuming extra step, as well as extra materials. Another solution to the problems associated with the conventional tape lettering process has been to cover the lettering tape with drafting tape for protection. This requires the extra step of applying the drafting tape, which must be additionally removed and reapplied each time the drawing is printed. In still another solution, the lettering tape may be applied only after completion of the drawings, thus avoiding the problems altogether. However, this is usually impractical since drawings are typically reviewed several times at different stages of their completion, normally requiring that they be lettered at those times.

SUMMARY OF THE INVENTION

The present invention provides an advantageous printing support and method for printing characters on a tape and attaching the tape to a drawing sheet. The print support is adapted for use in conventional tape lettering equipment without modification of the equipment. A typical example of such conventional equipment is shown and described in U.S. Pat. No. 3,834,507 to Bradshaw. The support of the present invention is preferably shaped as a circular disk, and is rotatable about its circular center. A plurality of raised characters are arranged on a first surface of the support, preferably in alphabetical and numerical order. When viewed through a support from the second support surface opposite the first support surface which second surface is the surface that faces the user, the characters would appear inverted relative to a readable orientation. By contrast, when viewed in the same fashion, the characters on a support as known in the prior art would appear in their proper readable orientation. When characters are printed on a transparent tape by a conventional lettering apparatus using the print support of the present invention and the tape is inverted, the characters will be readable through the tape from the surface opposite that on which the characters are printed. Thus, the tape may be read when inverted and attached to the underside of a transparent sheet, such as used for architectural and engineering drawings.

From the above description, several advantages of the present invention are apparent. The print support may be used on existing equipment in the usual manner without necessitating modifications of the equipment. Further, placing the lettered tape on the underside of a transparent drawing alleviates the problems of smudging, peeling, and scratching associated with having the tape exposed to contact on the top surface of the drawing.

These and other advantages of the present invention will become apparent with reference to the drawings, the description of the preferred embodiment and the claims.

BEST MODE FOR CARRYING OUT THE INVENTION

Figure 1:
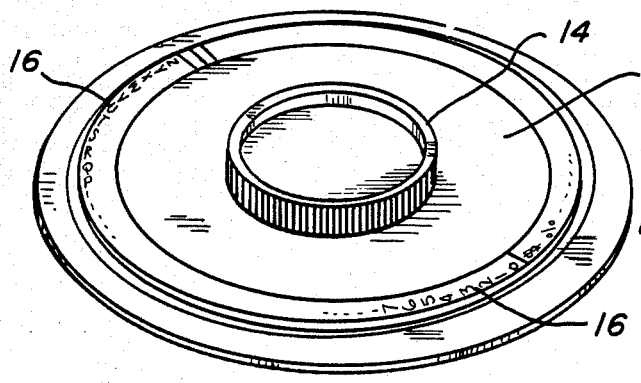
FIG. 1 is a top perspective view of the print support of the present invention.
Figure 2:
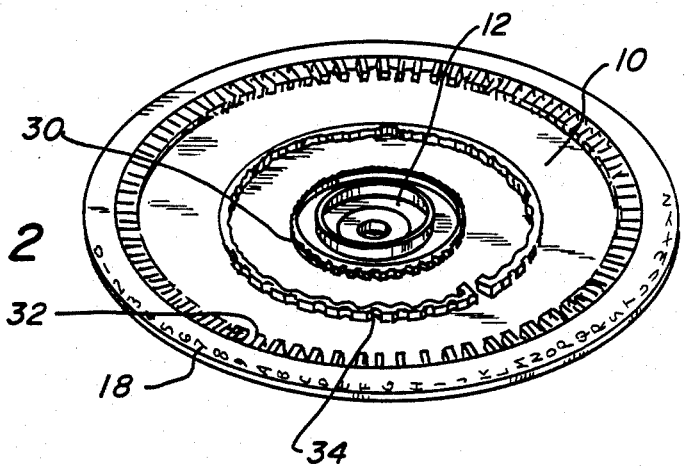
FIG. 2 is a bottom perspective view of the print support of the present invention.
Figure 3:
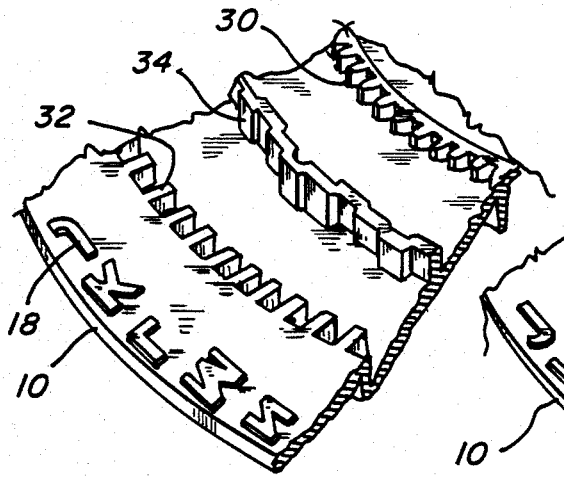
Fig 3 PRIOR ART
FIG. 3 is a bottom view of a portion of a print support as known in the prior art, showing the orientation of print characters thereon.
Figure 4:
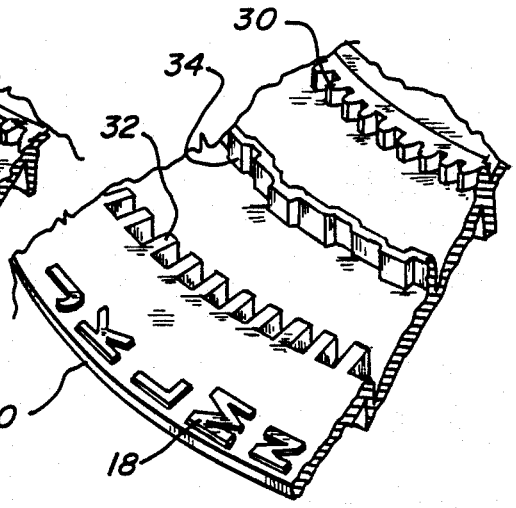
FIG. 4 is a bottom view of a portion of the print support of the present invention, showing the orientation of print characters thereon.
Figure 5:
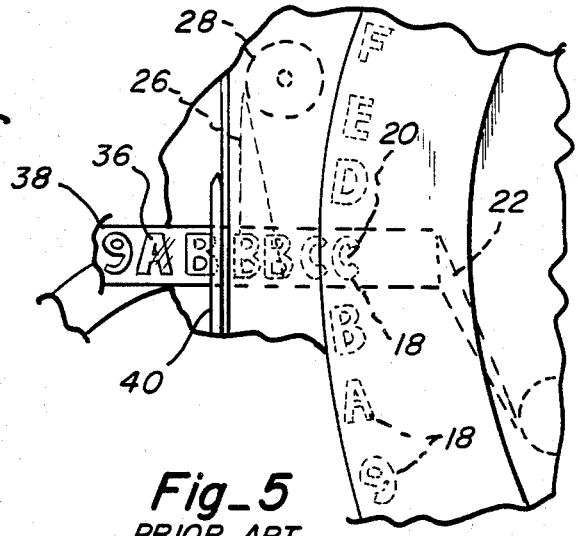
Fig 5 PRIOR ART
FIG. 5 is a plan view showing, partially in outline, the movement of the tapes through the print station and the printing of letters on the letter carrying tape, as known in the prior art.
Figure 8:
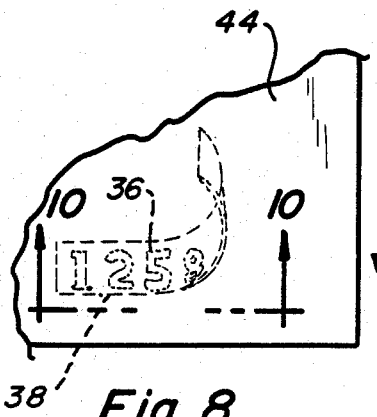
FIG. 8 is a top view of inverted lettered tape of the present invention being applied to the underneath surface of a transparent drawing sheet.

In accordance with the present invention, as depicted in FIGS. 1 and 2, a rotatable support 10 is provided which has mounting hub 12 for mounting the support 10 on a standard dry lettering printing apparatus (not shown) as commonly used for tape printing or lettering. On hand-driven models, a selector knob 14 allows the support 10 to be turned by hand to align a selected display character 16 for printing. Referring also to FIG. 5, it is seen that when a display character 16 is so selected, the corresponding print character 18 is aligned at the same time at print station 20. Print character 18 is preferably raised relative to support 10 in order to best perform the printing function. An image carrying tape 22 is fed from cartridge 24 and also aligned at printing station 20. In addition, a color carrying tape 26 is provided in alignment at print station 20, the color carrying tape 26 being fed from cartridge 24 and wound onto take-up reel 28.

Proper alignment of the support 10 is assured by several structural features of the support. Optional hub gears 30 allow the support to be driven by a drive mechanism included in the printing apparatus (not shown), as an alternative to turning the support 10 by hand. In an apparatus having a drive mechanism, print selection is typically accomplished by a keyboard mechanism (not shown), which obviates the need for display characters 16 on the support 10. Print selection notches 32 interact with corresponding parts of the printing apparatus to secure the support 10 in a selected position for printing, thereby assuring that a particular print character 18 remains in alignment at the print station 20. Spacing notches 34 interact with a corresponding spacing arm (not shown) on the printing apparatus to align each print character 18 in a spaced manner unique to that character relative to the image carrying tape 22. This individual alignment of each print character 18 with the tape 22 allows the uniquely shaped alphabetic and numeric characters 18 to be printed in a uniformly spaced array in the final printing. Once the image carrying tape 22, the color carrying tape 26, and the selected print character 18 are aligned at print station 20, the printing apparatus generates a force which compresses the character 18 onto the color carrying tape 26, which leaves a printed character 36 on image carrying tape 26. After all the desired printed characters 36 have been produced, the printed tape 38 comprising all the desired printed characters 36 is cut from the remaining tape 26, as by tape cutting edge 40.

Figure 6:
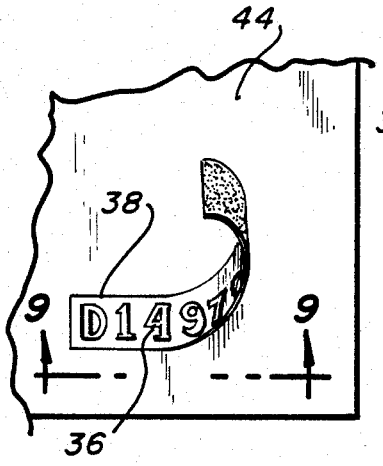
Fig 6 PRIOR ART
FIG. 6 is a top view of lettered tape being applied to the upper surface of a drawing sheet, as known in the prior art.
Figure 7:
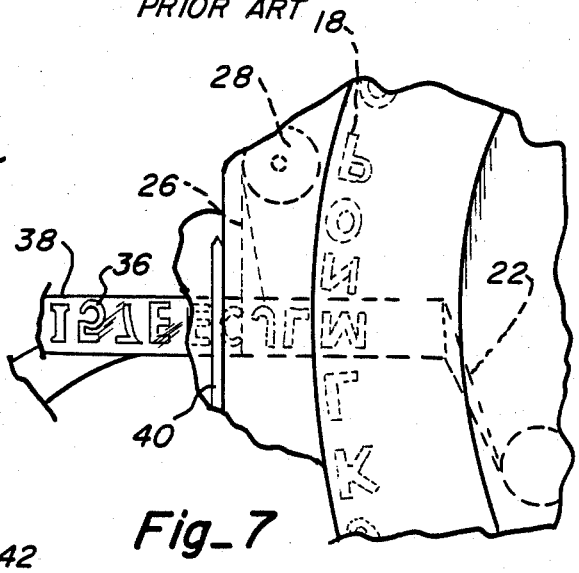
FIG. 7 is a plan view, partially in outline, showing the movement of the tapes through the print station and the printing of letters on the letter carrying tape in the present invention.
Figure 9:
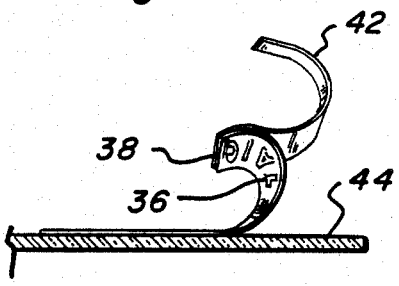
Fig 9 PRIOR ART
FIG. 9 is a side view taken along lines 9—9 of FIG. 6, showing lettered tape being applied to the upper surface of a drawing sheet, as known in the prior art.
Figure 10:
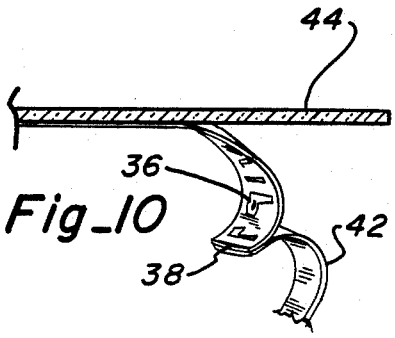
FIG. 10 is a side view taken along line 10—10 of FIG. 8, showing lettered tape of the present invention being applied to the underneath surface of a drawing sheet.

It is instructive at this point to compare the present invention of FIGS. 4, 7, 8 and 10 with the prior art, as shown in FIGS. 3, 5, 6 and 9. Looking at FIGS. 3 and 4, it is seen that the print characters 18 of the present invention are inverted relative to the corresponding characters 18 of the prior art. As seen in FIGS. 5, 6 and 9, the print characters 18 of the prior art support 10 are in readable orientation when viewed from above the support, resulting in an array of printed characters 36 in readable orientation on tape 26 after printing. The tape 26 has an adhesive backing 42 which is peeled off as shown in FIG. 9, allowing the printed tape 38 to be secured to the top surface of transparent sheet 44. Referring now to FIGS. 7, 9 and 10, the comparable process may be seen as performed with the present invention. It will be noted that the print characters 18 appear inverted relative to a readable orientation when viewed from above the support 10, which results in corresponding inverted print characters 36 after printing. After the backing 42 is peeled from the printed tape 38, the printed tape 38 is attached to the underneath surface of transparent sheet 44, shown in FIG. 10. The printed characters 36 then appear in a readable orientation when viewed through the tape 38 and the transparent sheet 44 from above. By thus allowing the printed tape 38 to be applied to the underneath side of the transparent sheet 44, the present invention protects the tape from almost all of the smudging, scratching, and accumulation of dirt associated with currently used conventional systems. The present invention requires no additional materials for its operation, and is well-suited for use on conventional systems without modification of existing equipment.

This invention has been described in detail with reference to a particular embodiment thereof, but it will be understood that various other modifications can be effected within the spirit and scope of this invention.

What is claimed is:

1. A method of placing print characters on a first transparent print medium to be attached to an undersurface of a second transparent print medium for viewing through an upper surface of said second medium, comprising the steps of:

successively printing selected print characters onto a first surface of said first transparent print medium in an orientation inverted relative to a correct orientation by a rotation of each character 180 degrees about its horizontal center line;

inverting said first transparent print medium by rotating said first print medium 180 degrees about its horizontal centerline so that the printed characters are readable in a correct orientation when viewed through said first print medium from a second surface opposite said first surface; and attaching said first print medium to an undersurface of said second transparent print medium causing said print characters to appear in a readable orientation when viewed through an upper surface of said second print medium opposite said undersurface.

2. The method of placing print characters on a print medium as claimed in claim 1, wherein:

said first print medium is removably attached to said second print medium by adhesive means on a second surface of said first transparent medium opposite said first surface.

3. The method of placing print characters on a print medium as claimed in claim 1, wherein:

said characters are printed onto said first print medium by pressing a type-bearing surface of a type font against said first surface of said first print medium, the individual types on said font being in a readable orientation when viewed from said type-bearing surface.

4. The method of placing print characters on a print medium as claimed in claim 3, wherein:

said first print medium is removably attached to said second print medium by adhesive means on a second surface of said first print medium opposite said first surface.

5. Apparatus for producing a print medium with print characters on an undersurface of the print medium which are readable from a top surface of the print medium, comprising the combination of:

print means having a type font of print characters arranged on a type-bearing surface, the individual characters of said font being in a readable orientation when viewed from said type-bearing surface;

a first print medium onto which print characters are formed by said print means, said characters on said first print medium being inverted relative to a readable orientation by a rotation of each character 180° about its horizontal center line; and a second print medium having an undersurface, said first print medium being inverted and attached to said undersurface of said second print medium, causing said print characters to appear in a readable orientation when viewed through an upper surface opposite said undersurface.

6. Apparatus as claimed in claim 5, wherein:

said first print medium is removably attached to said second print medium by adhesive means on a second surface of said first print medium opposite said first surface.

* * * * *